US009539715B2

(12) United States Patent
McClung

(10) Patent No.: US 9,539,715 B2
(45) Date of Patent: Jan. 10, 2017

(54) CONTROLLED PIVOT IMPACT TOOLS

(71) Applicant: Ingersoll-Rand Company, Davidson, NC (US)

(72) Inventor: Mark T. McClung, Andover, NJ (US)

(73) Assignee: Ingersoll-Rand Company, Davidson, NC (US)

( * ) Notice: Subject to any disclaimer, the term of this patent is extended or adjusted under 35 U.S.C. 154(b) by 492 days.

(21) Appl. No.: 14/157,506

(22) Filed: Jan. 16, 2014

(65) Prior Publication Data

US 2015/0196997 A1 Jul. 16, 2015

(51) Int. Cl.
*B25D 15/00* (2006.01)
*B25D 9/06* (2006.01)
*B25B 21/02* (2006.01)

(52) U.S. Cl.
CPC ..... *B25D 9/06* (2013.01); *B25B 21/026* (2013.01)

(58) Field of Classification Search
CPC ..... B25B 21/02; B25B 17/02; B25D 11/00; B25D 11/062; B25D 2217/0015; B25D 2250/241; B25D 9/06; B25D 9/04
USPC ..... 173/2, 29, 47–48, 90, 93, 109, 128,173/176–178; 310/50
See application file for complete search history.

(56) References Cited

U.S. PATENT DOCUMENTS 3,557,884 A * 1/1971 Allen ..... B25B 21/02 173/93.5
3,648,784 A * 3/1972 Schoeps ..... B25B 21/026 173/93.5
3,661,217 A * 5/1972 Maurer ..... B25B 21/026 173/93.5
4,287,956 A * 9/1981 Maurer ..... B25B 21/026 173/93.5
4,585,078 A * 4/1986 Alexandrov ..... B25B 21/026 173/93.5
5,906,244 A * 5/1999 Thompson ..... B25B 21/026 173/93.5
5,992,538 A 11/1999 Mercengill et al.
6,003,618 A 12/1999 Wallace
6,024,180 A * 2/2000 Lin ..... B25B 21/02 173/93
6,491,111 B1 * 12/2002 Livingston ..... B25B 21/02 173/93
6,598,684 B2 7/2003 Watanabe
6,945,337 B2 9/2005 Kawai et al.
7,204,322 B2 4/2007 Sakai
7,331,404 B2 2/2008 Pusateri
(Continued)

OTHER PUBLICATIONS

"2135TiMax 1/2" Air Impactool—Maximum Impact brochure, Ingersoll Rand Company, 2007, 3 pages.

*Primary Examiner* — Robert Long
(74) *Attorney, Agent, or Firm* — Barnes & Thornburg LLP

(57) ABSTRACT

Illustrative embodiments of controlled pivot impact tools are disclosed. In at least one illustrative embodiment, an impact tool may comprise a hammer configured to rotate about a first axis and to pivot about a second axis different from the first axis, where the hammer includes a cam groove formed in an outer surface of the hammer, an actuator coupled to the cam groove of the hammer and configured to pivot the hammer about the second axis between a disengaged position and an engaged position based on a position of the actuator along the cam groove, and an anvil configured to rotate about the first axis in response to being impacted by the hammer when the hammer is in the engaged position.

18 Claims, 6 Drawing Sheets

(56) References Cited

U.S. PATENT DOCUMENTS 7,510,023 B1* 3/2009 Cheng ..... B25B 21/02 173/93
7,513,317 B2 4/2009 Satou
7,562,720 B2 7/2009 Seith et al.
7,588,097 B2 9/2009 Kamegai et al.
7,607,492 B2 10/2009 Seith et al.
7,886,840 B2 2/2011 Young et al.
7,967,078 B2 6/2011 Aoki
2004/0149469 A1* 8/2004 Colangelo, III ..... B25B 21/026 173/93.5
2008/0099217 A1* 5/2008 Seith ..... B25B 21/026 173/1
2009/0195204 A1 8/2009 Gumpert
2010/0000749 A1* 1/2010 Andel ..... B25B 21/026 173/48
2010/0064864 A1* 3/2010 Kobayashi ..... B25B 21/004 81/464
2010/0101815 A1* 4/2010 Kobayashi ..... B25B 21/004 173/112
2010/0276168 A1 11/2010 Murthy et al.
2010/0300716 A1* 12/2010 Amend ..... B25B 21/026 173/93
2010/0319945 A1* 12/2010 Chen ..... B23B 45/008 173/48
2011/0214892 A1* 9/2011 Hecht ..... B25B 21/00 173/164
2012/0199372 A1 8/2012 Nishikawa et al.
2012/0279736 A1 11/2012 Tanimoto et al.
2013/0008679 A1 1/2013 Nishikawa et al.
2013/0014967 A1 1/2013 Ito et al.
2013/0025892 A1 1/2013 Mashiko et al.
2013/0233585 A1* 9/2013 Lin ..... B25F 5/005 173/216
2013/0319709 A1* 12/2013 Hecht ..... B25D 11/062 173/109
2014/0318820 A1* 10/2014 Liang ..... B25B 21/026 173/94
2014/0367132 A1* 12/2014 Tanaka ..... B25B 21/02 173/93
2015/0190909 A1* 7/2015 Ely ..... B25B 23/0035 173/93
2015/0202750 A1* 7/2015 Kobayashi ..... B25B 21/004 81/464
2015/0231769 A1* 8/2015 Golden ..... B25B 21/026 173/93

* cited by examiner

CONTROLLED PIVOT IMPACT TOOLS

TECHNICAL FIELD

The present disclosure relates, generally, to impact tools and, more particularly, to impact tools having controlled pivot impact mechanisms.

BACKGROUND

An impact tool (e.g., an impact wrench) may be used to install and remove fasteners. An impact tool generally includes a motor coupled to an impact mechanism. The impact mechanism converts torque provided by the motor into a series of powerful rotary blows directed from one or more hammers to an anvil that is integrally formed with (or otherwise coupled to) an output shaft of the impact tool. In typical impact mechanisms, the timing of these rotary blows is mechanically dependent on the size and shape of the hammer(s) and anvil, the rotational speed of the hammer(s), and other mechanical characteristics of the impact mechanism.

SUMMARY

According to one aspect, an impact tool may comprise a hammer configured to rotate about a first axis and to pivot about a second axis different from the first axis, the hammer including a cam groove formed in an outer surface of the hammer, an actuator coupled to the cam groove of the hammer and configured to pivot the hammer about the second axis between a disengaged position and an engaged position based on a position of the actuator along the cam groove, and an anvil configured to rotate about the first axis in response to being impacted by the hammer when the hammer is in the engaged position.

In some embodiments, the impact tool may further comprise a controller configured to sense a rotational speed of the hammer about the first axis and cause the actuator to pivot the hammer from the disengaged position, in which the hammer rotates about the first axis without impacting the anvil, to the engaged position, in which the hammer impacts the anvil, in response to the rotational speed of the hammer achieving a threshold rotational speed. The controller may be configured to cause the actuator to pivot the hammer from the engaged position to the disengaged position in response to the hammer impacting the anvil. The controller may be configured to sense a rotational position of the hammer about the first axis, sense a rotational position of the anvil about the first axis, and determine when to cause the actuator to pivot the hammer based on the rotational position of the hammer relative to the rotational position of the anvil.

In some embodiments, the controller may comprise a mechanical trigger configured to cause the actuator to pivot the hammer based on a force applied to the mechanical trigger in response to rotation of the hammer. The impact tool may further comprise a hammer frame supporting the hammer for rotation therewith about the first axis, a pivot pin coupled to a first side of the hammer frame, the pivot pin being disposed along the second axis, wherein the hammer includes a pivot groove formed in the outer surface of the hammer opposite the cam groove, the pivot pin being received in the pivot groove of the hammer, and a motor operably coupled to the hammer frame and configured to drive rotation of the hammer frame. The pivot pin of the hammer frame may be configured to rotate about the first axis when rotation of the hammer frame is driven by the motor. The hammer frame may include a channel defined in a second side of the hammer frame opposite the first side, and the actuator may be received in the channel.

According to another aspect, an impact tool may comprise a hammer configured to rotate about a first axis and to pivot about a second axis between a first position and a second position, where the second axis is parallel to and spaced apart from the first axis and the hammer having a void formed therein, and an anvil disposed within the void of the hammer and configured to rotate about the first axis in response to being impacted by the hammer, where the hammer is configured to impact the anvil while in the first position and to rotate freely about the anvil while in the second position.

In some embodiments, the hammer may be configured to impact the anvil while in the first position when rotating about the first axis in a clockwise direction and may be further configured to pivot about the second axis between the second position and a third position and to impact the anvil while in the third position when rotating about the first axis in a counterclockwise direction. The anvil may comprise a cylindrical body and an lug extending outward from the cylindrical body, and the hammer may comprise first and second impact jaws extending into the void formed in the hammer, the first impact jaw being configured to impact the lug of the anvil while the hammer is in the first position and the second impact jaw being configured to impact the lug of the anvil while the hammer is in the third position.

In some embodiments, the impact tool further comprises an actuator coupled to the hammer and configured to pivot the hammer about the second axis between the first, second, and third positions. The hammer may include a cam groove formed in an outer surface of the hammer, and the actuator may comprise a ball bearing that is received in and moves along the cam groove formed in the hammer. The cam groove formed in the hammer may be V-shaped with first and second sections that meet at a vertex, such that the ball bearing of the actuator is positioned at the vertex of the cam groove when the hammer is in the second position, the ball bearing of the actuator is positioned along the first section of the cam groove when the hammer is in the first position, and the ball bearing of the actuator is positioned along the second section of the cam groove when the hammer is in the third position.

According to yet another aspect, an impact tool may comprise a hammer configured to rotate about a first axis and to pivot about a second axis, where the second axis is parallel to and spaced apart from the first axis and the hammer has a void formed therein, an anvil disposed within the void of the hammer and configured to rotate about the first axis when impacted by the hammer, and an actuator positioned along a third axis that is parallel to and spaced apart from both the first axis and the second axis, where the actuator engages the hammer such that movement of the actuator along the third axis causes the hammer to pivot about the second axis.

In some embodiments, the actuator may engage a cam groove formed in an outer surface of the hammer. The actuator may be configured to pivot the hammer about the second axis between a disengaged position and an engaged position. The impact tool may further comprise a spring biasing the actuator along the third axis toward a first position in which the hammer is in the engaged position.

In some embodiments, the impact tool may further comprise an air motor configured to divert a motive fluid to the actuator to overcome a biasing force of the spring to move the actuator along the third axis toward a second position and thereby pivot the hammer to the disengaged position. The impact tool may further comprise a hammer frame supporting the hammer for rotation therewith about the first axis. The hammer frame may include a channel defined therein along the third axis, and the actuator may be received in the channel. The air motor may comprise a rotor operably coupled to the hammer frame to drive rotation of the hammer frame. An air passage may be defined in the rotor and the hammer frame. The air passage may be configured to divert the motive fluid to the channel defined in the hammer frame to move the actuator along the third axis.

BRIEF DESCRIPTION

The concepts described in the present disclosure are illustrated by way of example and not by way of limitation in the accompanying figures. For simplicity and clarity of illustration, elements illustrated in the figures are not necessarily drawn to scale. For example, the dimensions of some elements may be exaggerated relative to other elements for clarity. Further, where considered appropriate, reference labels have been repeated among the figures to indicate corresponding or analogous elements.

DETAILED DESCRIPTION

While the concepts of the present disclosure are susceptible to various modifications and alternative forms, specific exemplary embodiments thereof have been shown by way of example in the figures and will herein be described in detail. It should be understood, however, that there is no intent to limit the concepts of the present disclosure to the particular forms disclosed, but on the contrary, the intention is to cover all modifications, equivalents, and alternatives falling within the spirit and scope of the present disclosure.

An impact tool (e.g., an impact wrench) generally includes a motor and an impact mechanism configured to convert torque provided by the motor into a series of powerful rotary blows directed from one or more hammers of the impact mechanism to an anvil of the impact mechanism. One illustrative embodiment of an impact mechanism 10 according to the present disclosure is depicted in FIGS. 1-5B. It is contemplated that the impact mechanism 10 may be used in any suitable impact tool. The impact mechanism 10 is, in certain respects, similar to a Maurer-type impact mechanism, illustrative embodiments of which are disclosed in U.S. Pat. Nos. 3,661,217 and 4,287,956, both issued to Maurer, the entire disclosures of which are hereby incorporated by reference. While the timing of impacts between the hammer(s) and the anvil of a traditional Maurer-type impact mechanism is mechanically dependent upon the rotation of the hammer(s), the impact mechanism 10 of the present disclosure allows pivoting of the hammer (and, thus, impacts between the hammer and the anvil) to be controlled independently of the rotation of the hammer, as described in further detail below.

Figure 1:
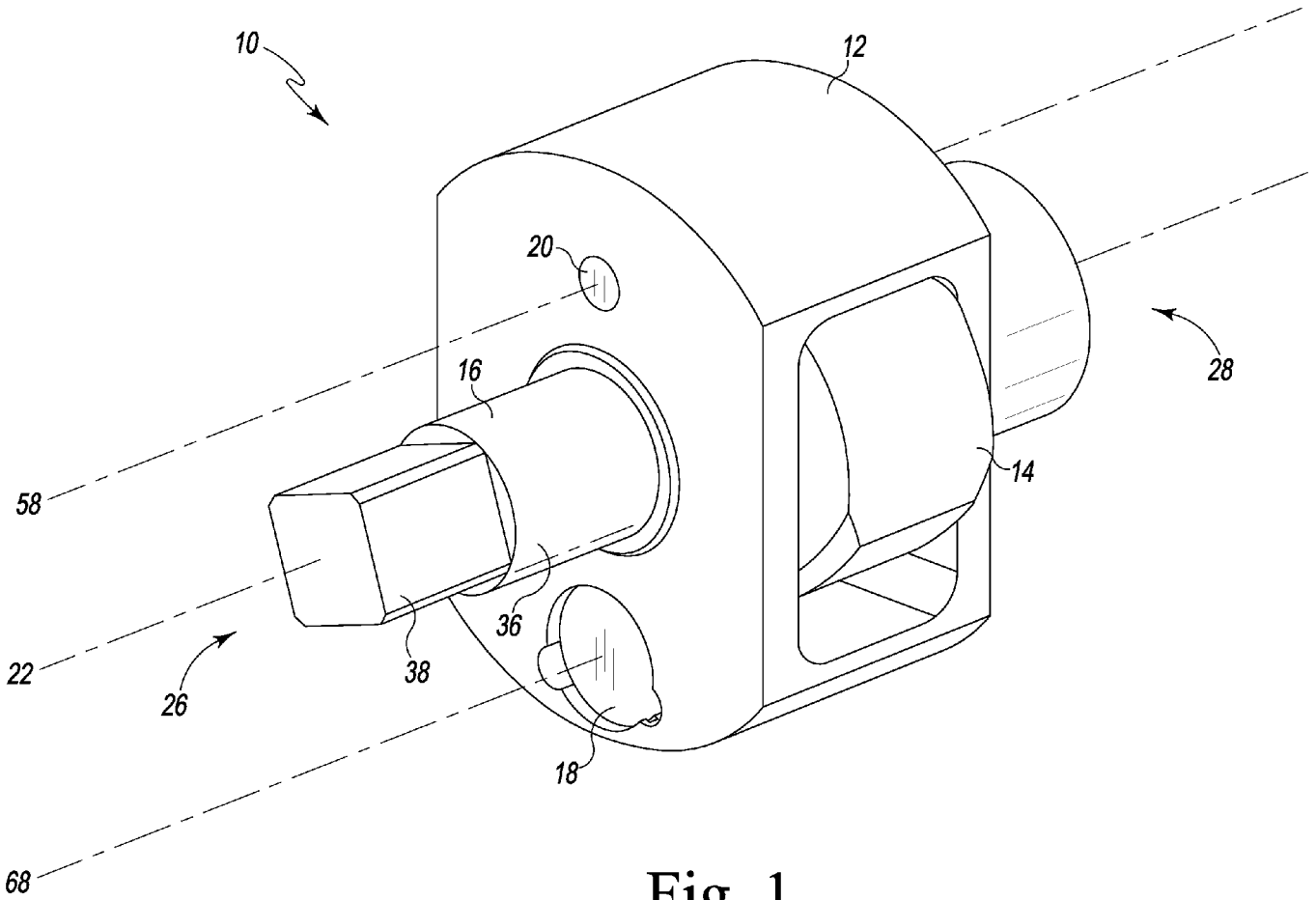
FIG. 1 is a perspective view of one illustrative embodiment of an impact mechanism of an impact tool.
Figure 2:
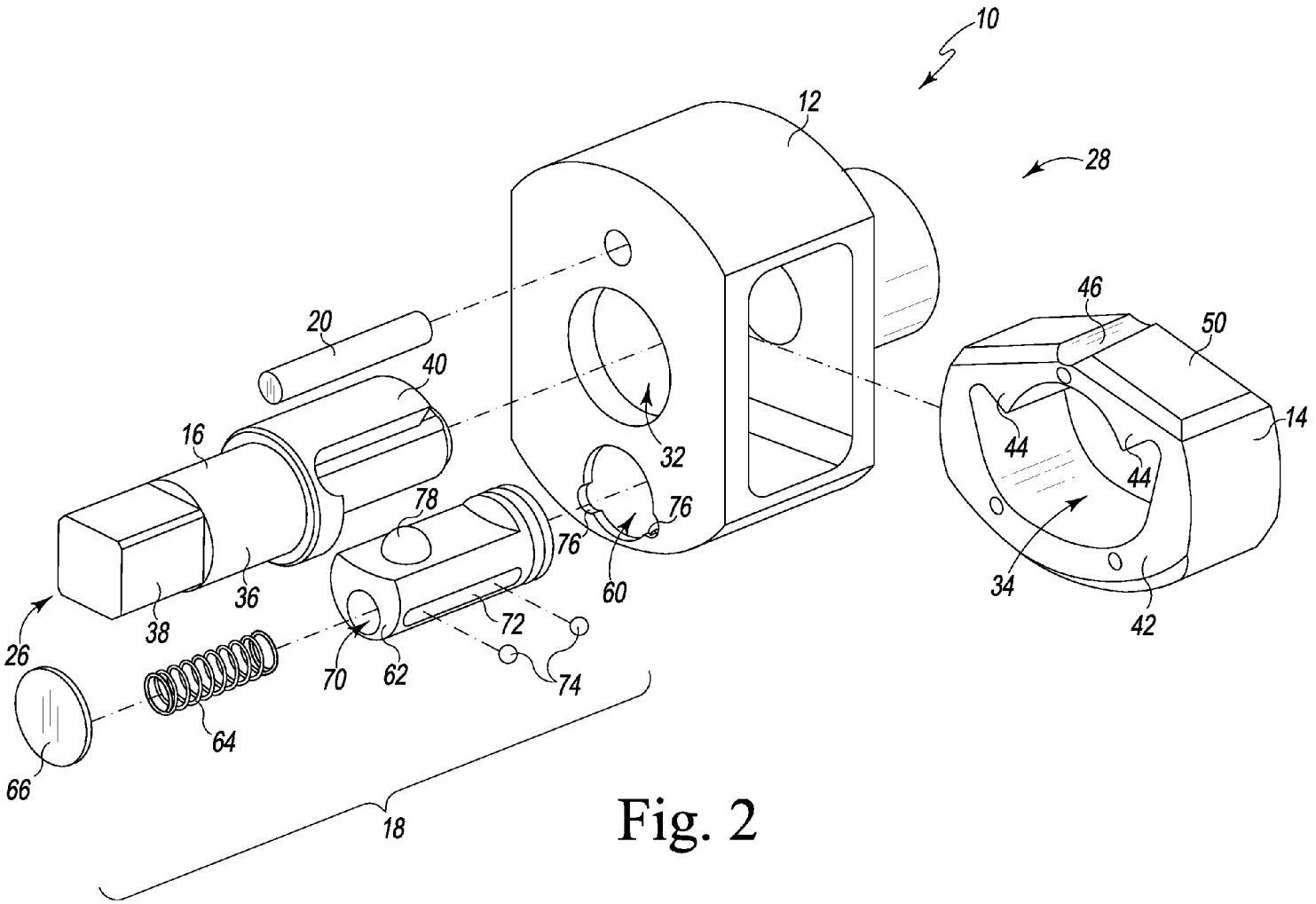
FIG. 2 is an exploded view of the impact mechanism of FIG. 1.

Referring now to FIGS. 1 and 2, the impact mechanism 10 illustratively includes a hammer frame 12, a hammer 14, an anvil 16, an actuator assembly 18, and a pivot pin 20. The hammer frame 12 is driven for rotation about an axis 22 by a motor 24. As illustratively shown in FIGS. 1 and 2, the axis 22 extends from a front output end 26 of the impact mechanism 10 to a rear input end 28 of the impact mechanism 10. The motor 24 is illustratively embodied as a pneumatically powered motor (e.g., an air motor) positioned within the impact tool. However, it is also contemplated that, in other embodiments, the impact mechanism 10 may be driven by an electric motor positioned within the impact tool.

The motor 24 includes a rotor 30 (see FIGS. 5A and 5B) that rotates about the axis 22. In the illustrative embodiment, where the motor 24 is an air motor, the rotor 30 includes a plurality of vanes that are configured to be driven by a supply of motive fluid (e.g., compressed air). One end of the rotor 30 is coupled to the hammer frame 12 such that rotation of the rotor 30 drives rotation of the hammer frame 12 about the axis 22. For example, in the illustrative embodiment, the rotor 30 is mechanically coupled directly to the hammer frame 12 via a geared interface. In other embodiments, additional components (e.g., gears) may be used to transfer rotation from the rotor 30 to the hammer frame 12. In still other embodiments, the rotor 30 and the hammer frame 12 may constitute a monolithic structure, rather than separate components coupled to one another. As described further below, the hammer 14 is coupled to the hammer frame 12 and is driven for rotation about the axis 22 by the rotation of the hammer frame 12. Further, the hammer 14 is configured to impact the anvil 16 (when in an engaged position), thereby driving rotation of the anvil 16 about the axis 22.

As best seen in FIG. 2, the anvil 16 extends along the axis 22 through an aperture 32 defined in the hammer frame 12 and a void 34 formed in the hammer 14. The anvil 16 includes a cylindrical body 36, an output shaft 38, and a lug 40. In the illustrative embodiment, the anvil 16 is shown as being integrally formed with the output shaft 38. In other embodiments, the anvil 16 and the output shaft 38 may be formed separately and coupled to one another. In such embodiments, the output shaft 38 would be configured to rotate as a result of the corresponding rotation of the anvil 16. The output shaft 38 may be configured to mate with a socket (e.g., for use in tightening and loosening fasteners, such as nuts and bolts). Although the output shaft 38 is illustratively shown as a square drive output shaft, the principles of the present disclosure may be applied to an output shaft 38 of any suitable size and shape. The motor 24 and the impact mechanism 10 are adapted to rotate the output shaft 38 in both clockwise and counterclockwise directions, for tightening and loosening fasteners. The lug 40 of the anvil 16 extends outward from the cylindrical body 36 of the anvil 16 and includes two opposing impact surfaces, as shown in FIG. 2.

Figure 3:
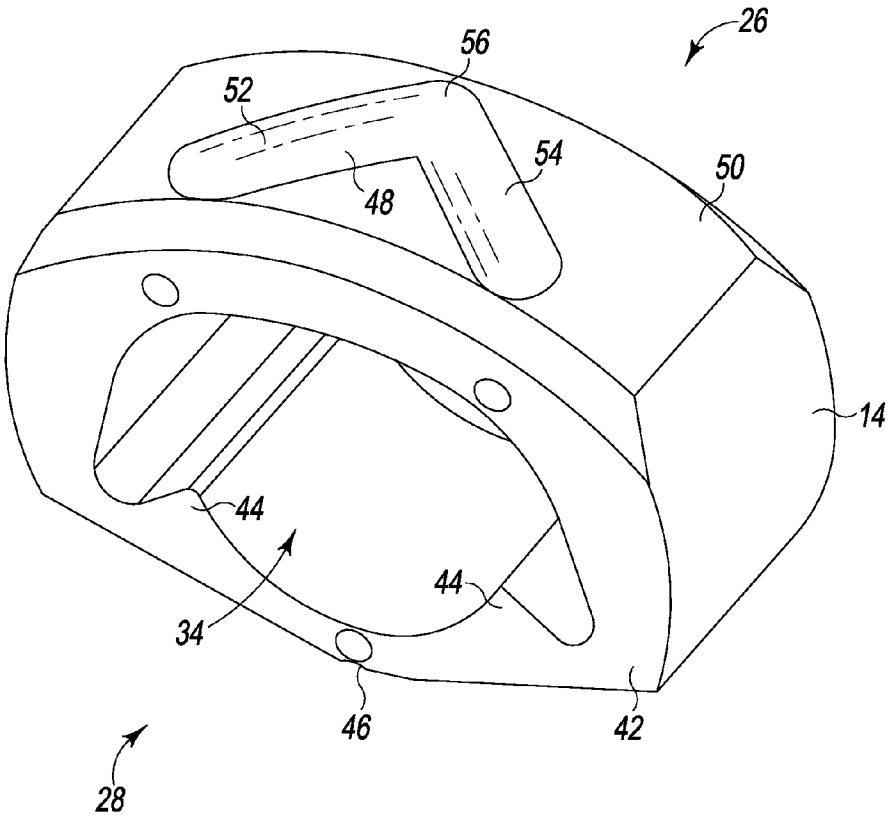
FIG. 3 is a perspective view of a hammer of the impact mechanism of FIG. 1.

As indicated above, the hammer 14 is formed to include a void 34 that receives the anvil 16 when the impact mechanism 10 is assembled. The void 34 is defined by an outer ring 42 of the hammer 14 and a pair of impact jaws 44 that extend inward from the outer ring 42 (toward the axis 22), as shown in FIGS. 2 and 3. Each of the impact jaws 44 includes an impact surface configured to impact a corresponding impact surface of the lug 40 of the anvil 16 (depending on the direction of rotation of the hammer 14) when the hammer 14 is in an engaged position. As discussed further below, the void 34 is sized to permit the hammer 14 to rotate freely around the anvil 16 (i.e., without either impact jaw 44 contacting the lug 40) when the hammer 14 is in a disengaged, or neutral, position.

In the illustrative embodiment, a pivot groove 46 and a cam groove 48 are each formed in an outer surface 50 of the hammer 14. In the illustrative embodiment shown in FIGS. 2 and 3, the pivot groove 46 and the cam groove 48 are formed on opposing sides of the hammer 14. The pivot groove 46 is defined in the outer surface 50 on a first side of the hammer 14 and extends substantially parallel to the axis 22. The cam groove 48 is formed in the outer surface 50 on a second side (opposite the first side) of the hammer 14. In the illustrative embodiment, the cam groove 48 is generally V-shaped with two sections 52, 54 that meet at a vertex 56. It should be appreciated that, in other embodiments, the cam groove 48 may have any other suitable shape. For example, in some embodiments, the cam groove 48 may be generally U-shaped. In still other embodiments, the cam groove 48 may have a generally linear shape (for instance, where pivoting of the hammer 14 between a disengaged position and only one engaged position is needed).

The pivot pin 20 is coupled to the hammer frame 12 and positioned along an axis 58. As will be appreciated from FIGS. 1 and 2, the pivot pin 20 and the axis 58 will rotate about the axis 22 when the hammer frame 12 rotates about the axis 22. In the illustrative embodiment, the axis 58 is generally parallel to and spaced apart from the axis 22. When the impact mechanism 10 is assembled, the pivot pin 20 is received in the pivot groove 46 of the hammer 14 such that the hammer 14 is pivotally coupled to the hammer frame 12. Accordingly, the hammer 14 is configured to both pivot about the pivot pin 20 (i.e., about the axis 58) and, based on rotation of the hammer frame 12, to rotate about the axis 22. Of course, due to pivoting of the hammer 14 relative to the pivot pin 20, the center of the hammer 14 may follow a complex, non-circular path as the hammer 14 rotates about the axis 22.

As shown in FIG. 2, a channel 60 (e.g., a generally cylindrical void) is defined in the hammer frame 12 and receives the actuator assembly 18 when the impact mechanism 10 is assembled. In the illustrative embodiment, the actuator assembly 18 includes an actuator 62, a spring 64, and an actuator cap 66. The actuator 62 is positioned along an axis 68, which is parallel to and spaced apart from both the axis 22 and the axis 58. As will be appreciated from FIGS. 1 and 2, the axis 68 will rotate about the axis 22 when the hammer frame 12 rotates about the axis 22. As shown in FIG. 2, the actuator 62 includes one or more axial grooves 72 defined therein. A number of ball bearings 74 are received between the axial grooves 72 and corresponding races 76 defined in the hammer frame 12. The ball bearings 74 couple the actuator 62 to the hammer frame 12, permitting the actuator 62 to move relative to the hammer frame 12 along the axis 68 (but restricting rotation of the actuator 62 about the axis 68).

The actuator 62 further includes a cam 78 that is received in and configured to move along the cam groove 48 of the hammer 14. As further described below, movement of the cam 78 along the cam groove 48 causes the hammer 14 to pivot about the pivot pin 20 (i.e., about the axis 58). In the illustrative embodiment, the cam 78 is embodied as a ball bearing 78 positioned in a recess formed in the actuator 62 such that about half of the ball bearing 78 is exposed. In other embodiments, the cam 78 may be integrally formed with the actuator 62 and embodied as, for example, a semi-spherical protrusion extending outward from an outer surface of the actuator 62. In still other embodiments, the cam 78 may be otherwise sized and/or shaped to movably couple the actuator 62 to the cam groove 48 of the hammer 14.

In the illustrative embodiment, the spring 64 is received in a void 70 defined in the actuator 62 and biases the actuator 62 toward the rear input end 28 of the impact mechanism 10. In other embodiments, the actuator assembly 18 may include other mechanisms for biasing the actuator 62 toward the rear input end 28 of the impact mechanism 10. In still other embodiments, the spring 64 (or another mechanism) may bias the actuator 62 toward the front output end 26 of the impact mechanism 10 (rather than the rear input end 28). The actuator cap 66 is coupled to the hammer frame 12 to cover the channel 60 at the front output end 26, after insertion of the other components of the actuator assembly 18 within the channel 60. The actuator cap 66 may be fastened to the hammer frame 12 using a press fit, taper fit, threading, and/or another fastening mechanism.

Figures 4A, 4B, 4C:
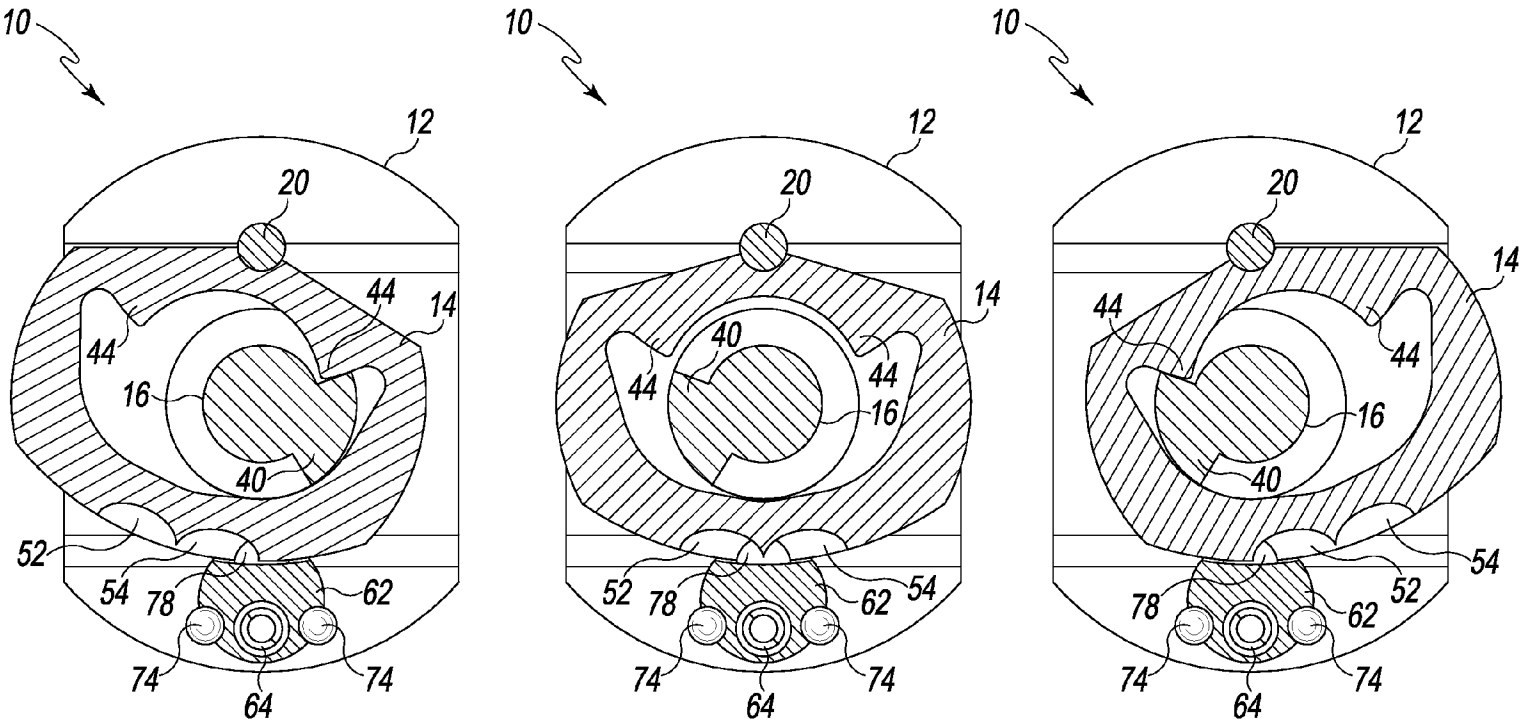
FIG. 4A is a cross-sectional view of the impact mechanism of FIG. 1, showing the hammer in an engaged position.
FIG. 4B is a cross-sectional view of the impact mechanism of FIG. 1, showing the hammer in a disengaged position.
FIG. 4C is a cross-sectional view of the impact mechanism of FIG. 1, showing the hammer in another engaged position.
Figure 5A:
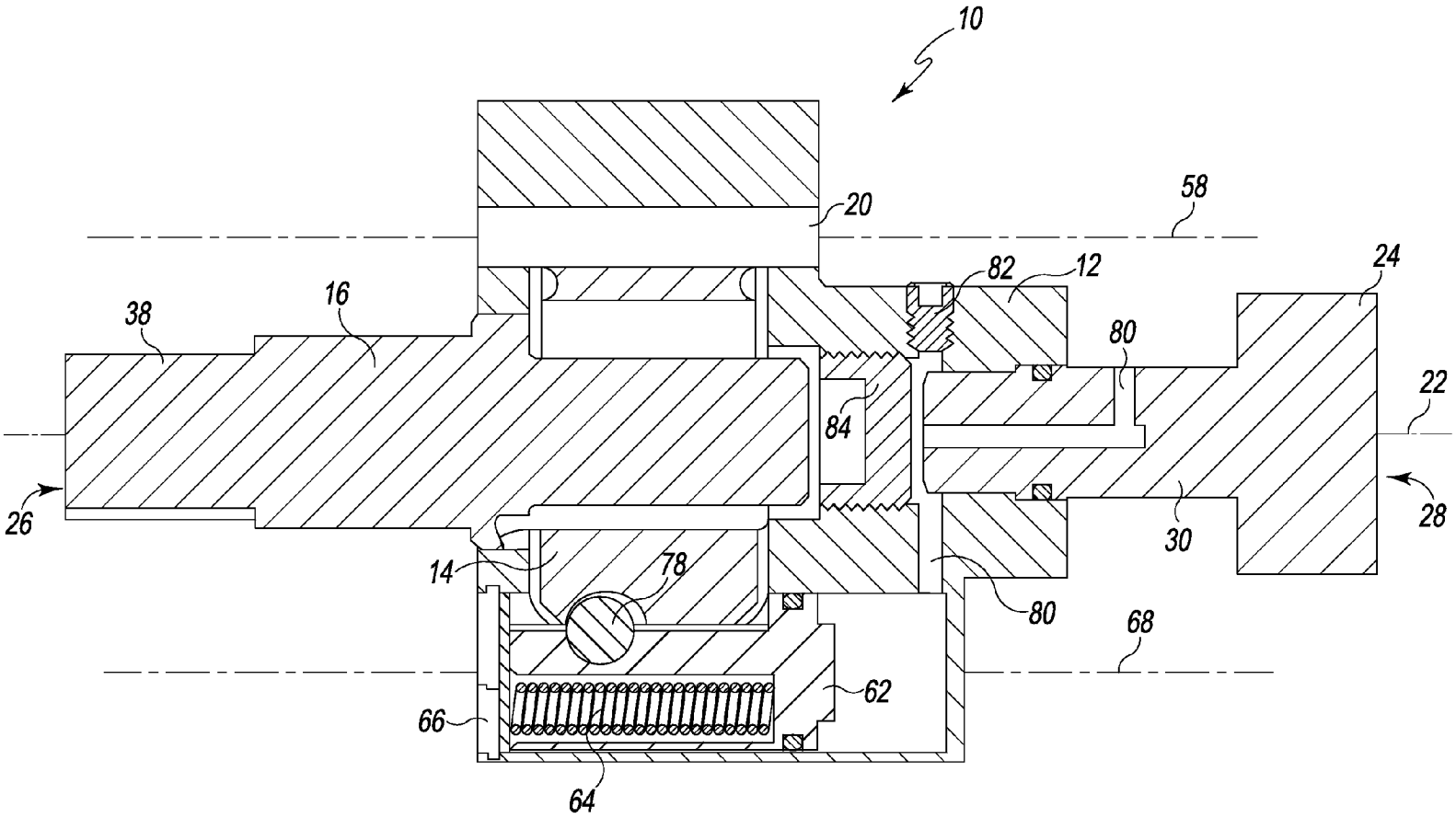
FIG. 5A is a cross-sectional view of the impact mechanism of FIG. 1 coupled to a rotor of a motor of the impact tool, showing the hammer in a disengaged position.

Referring now to FIGS. 4A-4C, the actuator 62 is configured to pivot the hammer 14 between a disengaged position, in which the hammer 14 rotates about the axis 22 without impacting the anvil 16 (as shown in FIG. 4B), and one or more engaged positions, in which one of the impact jaws 44 of the hammer 14 will impact the lug 40 of the anvil 16 (as shown in FIGS. 4A and 4C). More specifically, when the actuator 62 is positioned such that the ball bearing 78 is located at the vertex 56 of the cam groove 48 (in the illustrative embodiment, when the actuator 62 is positioned toward the front output end 26 of the impact mechanism 10, as shown in FIG. 5A), the hammer 14 is centered relative to the hammer frame 12 and in the disengaged position shown in FIG. 4B. As noted above, when the hammer 14 is in this disengaged position, the hammer 14 is able to rotate freely around the anvil 16 without either impact jaw 44 contacting the lug 40 of the anvil 16.

Figure 5B:
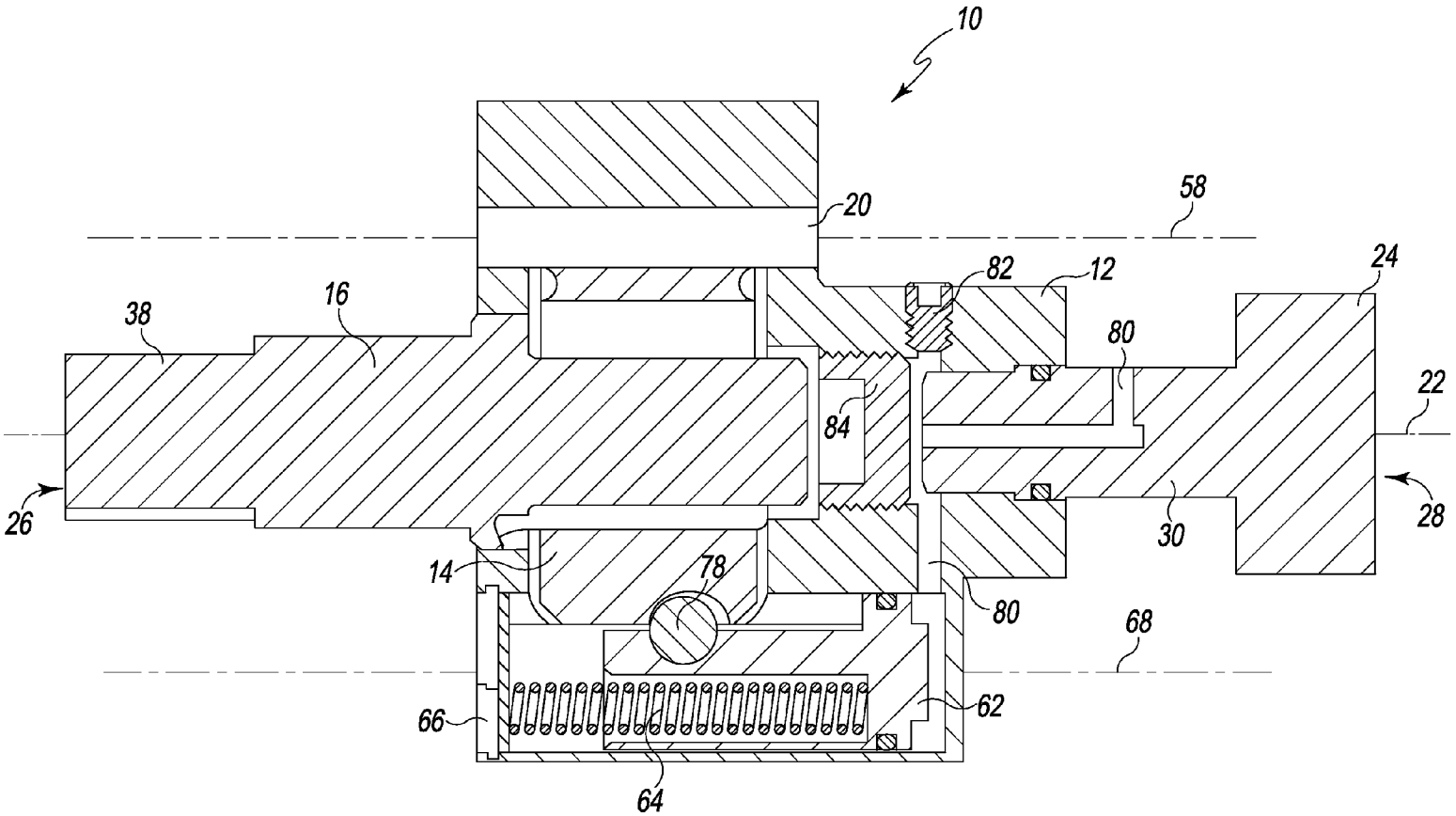
FIG. 5B is a cross-sectional view of the impact mechanism of FIG. 1 coupled to the rotor of the motor of the impact tool, showing the hammer in an engaged position.

When the actuator 62 moves to along the axis 68 (in the illustrative embodiment, when the actuator 62 moves toward the rear input end 28 of the impact mechanism 10, as shown in FIG. 5B), the ball bearing 78 will travel along one of the two sections 52, 54 of the cam groove 48, causing the hammer 14 to pivot about the axis 58 to one of the engaged positions shown in FIGS. 4A and 4C. In particular, when the ball bearing 78 of the actuator 62 moves along the section 52 of the cam groove 48, the hammer 14 will be pivoted to the engaged position shown in FIG. 4C (e.g., during clockwise rotation of the impact mechanism 10 for tightening of fasteners). When the ball bearing 78 of the actuator 62 moves along the section 54 of the cam groove 48, the hammer 14 will be pivoted to the engaged position shown in FIG. 4A (e.g., during counterclockwise rotation of the impact mechanism 10 for loosening of fasteners). In some embodiments, the ball bearing 78 may be biased to move along the section 52 during clockwise rotation and along the section 54 during counterclockwise rotation.

As indicated above, the spring 64 biases the actuator 62 toward the rear input end 28 of the impact mechanism 10. Referring now to FIGS. 5A and 5B, the motor 24 is configured to supply motive fluid (e.g., compressed air) to the actuator 62 through a passageway 80 (defined partially in the rotor 30 and partially in the hammer frame 12) to overcome the bias force supplied by the spring 64 and move the actuator 62 toward the front output end 26 of the impact mechanism 10. The impact tool includes a valve (not shown) that is positioned in fluid communication with the passageway 80. In the illustrative embodiment, this valve is located upstream of the passageway 80 shown in FIGS. 5A and 5B. The valve is configured to selectively divert motive fluid from the passage that supplies the motor 24 to the passageway 80, when the valve is opened. The valve may be embodied as any suitable type of valve, such as an electronically controlled solenoid valve that opens or closes in response to an electrical control signal.

When the valve is open, motive fluid will travel through the passageway 80 to reach the actuator 62 and move the actuator 62 (against the bias force of the spring 64) toward the front output end 26 of the impact mechanism 10, as shown in FIG. 5A. In contrast, when the valve is closed, little or no motive fluid will enter the passageway 80. As such, when the valve is closed, an insufficient amount of motive fluid will be supplied to the actuator 62 to overcome the bias of the spring 64, thereby allowing the spring 64 to move the actuator 62 toward the rear input end 28 of the impact mechanism 10, as shown in FIG. 5B. It is contemplated that, in other embodiments, the impact mechanism 10 may be configured such that the actuator 62 is biased toward the front output end 26 and motive fluid is selectively supplied to move the actuator 62 toward the rear input end 28. In the illustrative embodiment, the impact mechanism 10 further includes plugs 82, 84 that are inserted into holes formed in the hammer frame 12 (for example, during machining of the hammer frame 12) to seal the passageway 80.

The impact tool may further include a control system configured to control movement of the actuator 62 and, hence, pivoting of the hammer 14 of the impact mechanism 10. For example, in the illustrative embodiment, the impact tool includes an electronic controller that is configured to open and close the valve, thereby controlling the supply of motive fluid to the actuator 62 and the pivoting of the hammer 14 between the disengaged and engaged positions. The illustrative impact mechanism 10 also includes one or more sensors (not shown) configured to sense, directly or indirectly, various operational characteristics of the impact mechanism 10, which may be used by the electronic controller to determine when to pivot the hammer 14 from the disengaged position to one of the engaged positions. These sensors may be configured to sense, for example, the rotational position of various components of the impact mechanism 10 (e.g., the hammer frame 12, the hammer 14, the anvil 16) and/or the rotational speed at which such components are traveling.

The electronic controller may interpret signals sent by such sensors and may activate or energize electronically-controlled components associated with the impact mechanism 10 (e.g., the valve). In the illustrative embodiment, the electronic controller may be configured to permit the hammer 14 to rotate freely in the disengaged position until a threshold rotational speed of the hammer 14 or other threshold value has been achieved. Once that threshold has been achieved, the controller may instruct the valve (e.g., via electrical signals sent to the valve) to cease supplying motive fluid to the passageway 80 to allow the actuator 62 to move the hammer 14 to the one of the engaged positions to deliver an impact blow to the anvil 16.

The particular attribute and value defining the threshold value may vary depending on the particular embodiment and the particular sensors used. For example, in an embodiment in which the sensors are used to determine the rotational speed of the hammer 14, the controller may compare the sensed speed values to a threshold rotational speed to determine whether the threshold rotational speed has been achieved (i.e., met or exceeded). It will be appreciated that sensed values may be used, for example, to derive other values that may be compared to a threshold. Further, in some embodiments, the controller may determine when to pivot the hammer 14 to the engaged position based on user input such as, for example, a user-selected rotational speed of the hammer 14, a user-selected number of skipped impact blows between the hammer 14 and the anvil 16, or a user-selected elapsed time.

As mentioned above, in some embodiments, the sensors may sense a rotational position of the hammer 14 about the axis 22 and a rotational position of the anvil 16 about the axis 22. The controller may utilize such sensed data to determine when to cause the actuator 62 to pivot the hammer 14. That is, the controller may cause the actuator 62 to pivot the hammer 14 to an engaged position at a point in time that would permit full impact between the impact jaw 44 of the hammer 14 and the lug 40 of the anvil 16 (e.g., to result in a force vector in generally the same direction as the traditional Maurer force vector). In yet another embodiment, the controller may utilize angular data associated with components of the impact mechanism 10 to determine when to pivot the hammer 14 to an engaged position.

It is also contemplated that, in other embodiments, the impact tool may include an entirely mechanical (rather than electromechanical) control system, in which the controller of the impact mechanism 10 includes a mechanical trigger configured to control operation of the valve that supplies motive fluid to the passageway 80. U.S. patent application Ser. No. 14/099,266, filed on Dec. 6, 2013 by the same applicant as the present application and entitled "Impact Tools with Speed Controllers" (the entire disclosure of which is hereby incorporated by reference), describes at least one suitable mechanical trigger in the form of a mechanical speed controller. For example, the speed controller disclosed in that application may be mounted to rotate with (or at a speed proportional to) the hammer 14 such that, in response in response to rotation of the hammer 14, a force is applied to move a plunger of the speed controller. The plunger may be configured to close the valve (e.g., by virtue of moving a predetermined distance) in response to the hammer 14 achieving a threshold rotational speed.

During operation of the impact mechanism 10, the rotor 30 of the motor 24 drives rotation of the hammer frame 12 and thereby drives rotation of the hammer 14 about the axis 22. At the same time, the valve supplies motive fluid to the actuator 62 (via the passageway 80) to overcome the biasing force of the spring 64 and maintain the hammer 14 in the disengaged position, as shown in FIGS. 4B and 5B. As such, the ball bearing 78 of the actuator 62 is positioned at the vertex 56 of the cam groove 48 of the hammer 14, and the hammer 14 rotates freely around the anvil 16 without impacting the anvil 16. As described above, the controller may allow the rotational speed of the hammer 14 to be increased while the hammer 14 is in the disengaged position, until a threshold rotational speed of the hammer 14 has been achieved.

After the threshold rotational speed of the hammer 14 has been achieved, the controller causes the valve to cease supplying motive fluid to the passageway 80 and thereby allows the biasing force of the spring 64 to move the actuator 62 toward the rear input end 28 of the impact mechanism 10, as shown in FIG. 5A. As indicated above, if the hammer 14 is rotating in the clockwise direction, the ball bearing 78 of the actuator 62 is configured to move along the section 52 of the cam groove 48, as shown in FIG. 4C. However, if the hammer 14 is rotating in the counterclockwise direction, the ball bearing 78 is configured to move along the section 54 of the cam groove 48, as shown in FIG. 4A. Once in one of these engaged positions, one of the impact jaws 44 of the hammer 14 will impact the lug 40 of the anvil 16 during the next rotation. As discussed above, in the illustrative embodiment, the timing of the actuation may account for the rotational positions of the hammer 14 and the anvil 16 relative to one another to ensure, for example, full impact between the impact jaw 44 and the lug 40. After an impact, the controller is configured to cause the actuator 62 to pivot the hammer 14 from one of the engaged positions back to the disengaged position, until the hammer 14 again achieves the threshold rotational speed. In the illustrative embodiment, the controller does so by opening the valve to supply motive fluid to the actuator 62 to overcome the biasing force of the spring 64 and move the actuator 62 back toward the front output end 26 of the impact mechanism 10.

While certain illustrative embodiments have been described in detail in the figures and the foregoing description, such an illustration and description is to be considered as exemplary and not restrictive in character, it being understood that only illustrative embodiments have been shown and described and that all changes and modifications that come within the spirit of the disclosure are desired to be protected. For example, while the impact mechanism 10 has been illustratively shown and described as including one hammer 14, it will be appreciated that the concepts of the present disclosure might also be applied to impact mechanisms including two or more hammers.

There are a plurality of advantages of the present disclosure arising from the various features of the apparatus, systems, and methods described herein. It will be noted that alternative embodiments of the apparatus, systems, and methods of the present disclosure may not include all of the features described yet still benefit from at least some of the advantages of such features. Those of ordinary skill in the art may readily devise their own implementations of the apparatus, systems, and methods that incorporate one or more of the features of the present disclosure.

The invention claimed is:

1. An impact tool comprising:

a hammer configured to rotate about a first axis and to pivot about a second axis different from the first axis, the hammer including a cam groove formed in an outer surface of the hammer;

an actuator coupled to the cam groove of the hammer and configured to pivot the hammer about the second axis between a disengaged position and an engaged position based on a position of the actuator along the cam groove; and an anvil configured to rotate about the first axis in response to being impacted by the hammer when the hammer is in the engaged position; further comprising a controller configured to:

sense a rotational speed of the hammer about the first axis; and cause the actuator to pivot the hammer from the disengaged position, in which the hammer rotates about the first axis without impacting the anvil, to the engaged position, in which the hammer impacts the anvil, in response to the rotational speed of the hammer achieving a threshold rotational speed.

2. The impact tool of claim 1, wherein the controller is configured to cause the actuator to pivot the hammer from the engaged position to the disengaged position in response to the hammer impacting the anvil.

3. The impact tool of claim 1, wherein the controller is further configured to:

sense a rotational position of the hammer about the first axis;

sense a rotational position of the anvil about the first axis; and determine when to cause the actuator to pivot the hammer based on the rotational position of the hammer relative to the rotational position of the anvil.

4. The impact tool of claim 1, wherein the controller comprises a mechanical trigger configured to cause the actuator to pivot the hammer based on a force applied to the mechanical trigger in response to rotation of the hammer.

5. The impact tool of claim 1, further comprising:

a hammer frame supporting the hammer for rotation therewith about the first axis;

a pivot pin coupled to a first side of the hammer frame, the pivot pin being disposed along the second axis, wherein the hammer includes a pivot groove formed in the outer surface of the hammer opposite the cam groove, the pivot pin being received in the pivot groove of the hammer; and a motor operably coupled to the hammer frame and configured to drive rotation of the hammer frame.

6. The impact tool of claim 5, wherein the pivot pin of the hammer frame is configured to rotate about the first axis when rotation of the hammer frame is driven by the motor.

7. The impact tool of claim 5, wherein:

the hammer frame includes a channel defined in a second side of the hammer frame opposite the first side; and the actuator is received in the channel.

8. An impact tool comprising:

a hammer configured to rotate about a first axis and to pivot about a second axis between a first position and a second position, the second axis being parallel to and spaced apart from the first axis, the hammer having a void formed therein; and an anvil disposed within the void of the hammer and configured to rotate about the first axis in response to being impacted by the hammer, wherein the hammer is configured to impact the anvil while in the first position and to rotate freely about the anvil while in the second position; wherein:

the hammer is configured to impact the anvil while in the first position when rotating about the first axis in a clockwise direction; and the hammer is further configured to pivot about the second axis between the second position and a third position and to impact the anvil while in the third position when rotating about the first axis in a counterclockwise direction.

9. The impact tool of claim 8, wherein:

the anvil comprises a cylindrical body and a lug extending outward from the cylindrical body; and the hammer comprises first and second impact jaws extending into the void formed in the hammer, the first impact jaw being configured to impact the lug of the anvil while the hammer is in the first position and the second impact jaw being configured to impact the lug of the anvil while the hammer is in the third position.

10. The impact tool of claim 8, further comprising an actuator coupled to the hammer and configured to pivot the hammer about the second axis between the first, second, and third positions.

11. The impact tool of claim 10, wherein:

the hammer includes a cam groove formed in an outer surface of the hammer; and the actuator comprises a ball bearing that is received in and moves along the cam groove formed in the hammer.

12. The impact tool of claim 11, wherein the cam groove formed in the hammer is V-shaped with first and second sections that meet at a vertex, such that the ball bearing of the actuator is positioned at the vertex of the cam groove when the hammer is in the second position, the ball bearing of the actuator is positioned along the first section of the cam groove when the hammer is in the first position, and the ball bearing of the actuator is positioned along the second section of the cam groove when the hammer is in the third position.

13. An impact tool comprising:

a hammer configured to rotate about a first axis and to pivot about a second axis, the second axis being parallel to and spaced apart from the first axis, the hammer having a void formed therein;

an anvil disposed within the void of the hammer and configured to rotate about the first axis when impacted by the hammer; and an actuator positioned along a third axis that is parallel to and spaced apart from both the first axis and the second axis, wherein the actuator engages the hammer such that movement of the actuator along the third axis causes the hammer to pivot about the second axis.

14. The impact tool of claim 13, wherein the actuator engages a cam groove formed in an outer surface of the hammer and is configured to pivot the hammer about the second axis between a disengaged position and an engaged position.

15. The impact tool of claim 14, further comprising a spring biasing the actuator along the third axis toward a first position in which the hammer is in the engaged position.

16. The impact tool of claim 15, further comprising an air motor configured to divert a motive fluid to the actuator to overcome a biasing force of the spring to move the actuator along the third axis toward a second position and thereby pivot the hammer to the disengaged position.

17. The impact tool of claim 16, further comprising a hammer frame supporting the hammer for rotation therewith about the first axis, wherein the hammer frame includes a channel defined therein along the third axis and the actuator is received in the channel.

18. The impact tool of claim 16, wherein:

the air motor comprises a rotor operably coupled to the hammer frame to drive rotation of the hammer frame; and an air passage is defined in the rotor and the hammer frame, the air passage being configured to divert the motive fluid to the channel defined in the hammer frame to move the actuator along the third axis.

* * * * *